US006889742B1

(12) United States Patent
Jensen et al.

(10) Patent No.: US 6,889,742 B1
(45) Date of Patent: May 10, 2005

(54) FULL MOLD CASTING PROCESS AND DEVICE FOR A DIFFERENTIAL CASE WITH CAST-IN BOLT HOLES

(75) Inventors: William Glen Jensen, Fort Wayne, IN (US); Michael J Catalano, Fort Wayne, IN (US)

(73) Assignee: Torque-Traction Technologies, Inc., Maumee, OH (US)

( * ) Notice: Subject to any disclaimer, the term of this patent is extended or adjusted under 35 U.S.C. 154(b) by 0 days.

(21) Appl. No.: 10/207,053

(22) Filed: Jul. 30, 2002

(51) Int. Cl.[7] ..... B22C 9/02; B22C 9/04
(52) U.S. Cl. ..... 164/34; 164/45
(58) Field of Search ..... 164/34, 45, 235, 164/246

(56) References Cited

U.S. PATENT DOCUMENTS 4,877,078 A * 10/1989 Wittmoser ..... 164/34
4,907,638 A * 3/1990 Hubbell et al. ..... 164/45
5,035,276 A 7/1991 Corbett et al. ..... 164/34
5,119,882 A 6/1992 Corbett ..... 164/246
5,121,787 A 6/1992 Corbett ..... 164/235
5,295,413 A 3/1994 Sherman ..... 74/606 R
5,755,271 A * 5/1998 Williamson ..... 164/34
6,227,333 B1 * 5/2001 Scheib et al. ..... 184/6.22
6,715,536 B1 * 4/2004 Jensen ..... 164/235

* cited by examiner

*Primary Examiner*—Kevin P. Kerns
(74) *Attorney, Agent, or Firm*—Liniak, Berenato & White

(57) ABSTRACT

A peripheral flange formed on a differential case for mounting a ring gear and the peripheral flange is provided with a plurality of cast-in bolt holes for bolting up the ring gear to the differential case using the lost foam casting process for making the differential case. A method of making a gear case eliminates the process of machining of the bolt holes in the differential case casting, thus reducing cost of manufacturing the differential case.

9 Claims, 7 Drawing Sheets

FULL MOLD CASTING PROCESS AND DEVICE FOR A DIFFERENTIAL CASE WITH CAST-IN BOLT HOLES

BACKGROUND OF THE INVENTION

1. Field of the Invention

The instant invention relates to a full mold casting process for a differential case member with cast-in bolt holes in which a complete positive model, made of a thermally decomposable material, is placed into a molding box filled with sand. The sand may be compacted by any suitable method such as shaking, and the casting metal is poured on the thermally decomposable model. The model is decomposed by the casting heat.

2. Description of Related Art

To produce castings, molds consisting of two halves are generally used.

However, this division of the molds is only possible within certain dimensional tolerances, and as a consequence, defects may occur within the mold joint due to offset burrs, sand washouts, metal penetrating into the sand mold, charred portions of sand, and the like. All these defects appear on the casting and must be eliminated by grinding, stripping, knocking, sawing, or the like.

Moreover, the prior art technique related to differential case members requires a machining process for the bolt holes where the bolt holes are machined into the casting.

To avoid extensive manual tasks, a so-called evaporative or full mold casting process has been proposed whereby a pattern is formed of an evaporable foam material, such as polystyrene, and is identical to the configuration of the metal part to be cast. The pattern is placed in a mold and a flowable material such as sand is introduced into the mold and surrounds the pattern as well as filling the cavities in the pattern. In the casting process, molten metal is introduced into the mold and the heat of the molten metal will vaporize the foam material with the vapor being trapped within the interstices of the sand, while the molten metal will fill the voids created by vaporization of the pattern to provide a cast metal part which is identical in configuration to the evaporable foam pattern. When such an undivided model is used, a casting without burrs is produced.

It has been found, however, that not all types of models can be molded in this manner and it is especially difficult to satisfactorily embed moldings with dome-shaped cavities, such as one-piece differential case members and similar shapes, in the sand because the sand does not rise to fill these cavities. It is, therefore, a disadvantage of this known lost foam casting process that such moldings cannot be molded and cast in this process in an efficient and effective manner but must be produced with batch cores or in the conventional molding process, in several parts. As an alternative, attempts have been made to distribute sand by an extreme amount of shaking of the molding flask. This shaking can cause damage to the foam pattern causing dimensional inaccuracies. In addition, the excess shaking will also increase the cost of the part due to the longer cycle times for filling the flask and excessive wear on the molding machine. All molds in which the sand would have to rise into such cavities as well as into communicating pipes are, therefore, inefficient and ineffective with the known full mold casting process for one-piece differential case member and the like.

The need therefore exists for a method of making a differential case or other similar article using lost foam casting whereby sand is allowed to flow into the interior of the part where the sand would otherwise not have access.

Moreover, the need exists for a process that eliminates the need to separately machine the bolt holes into the casting of a differential case.

SUMMARY OF THE INVENTION

It is the object of the instant invention to improve the full mold casting process so that moldings with crucial cavities can also be molded and filled safely by the molding sand.

It is also an object of the invention to provide a method and apparatus to mold a differential case having cast in place bolt holes to allow the bolting up of the ring gear to the differential case using a lost foam process for making a differential case. The cast in holes preferably further include chamfers on one or both sides of the flange.

A further object consists in distributing the molding sand in a controlled manner without excessive shaking.

Some objects are attained through the invention in that the part is formed with holes on the dome-shaped portion, i.e., the flange and button sides of the differential case, that allow sand to freely flow into the interior of the casting.

In an advantageous further object of the process the weight of the part is reduced and damage to the foam pattern is reduced or eliminated. As a result, dimensional inaccuracies of the part are reduced or eliminated. The invention makes it possible to achieve reliable density of the sand on all sides around the molding pattern without danger of the sand being loosened.

By introducing the flow-through holes into the casting model, preferably through the flange and button sides, all cavities of the casting model are completely filled with sand and the latter is compressed against the model. The rising of the sand in the model cavity is facilitated by the fact that the filling level of the molding sand is kept nearly constant near the model cavity to be filled until the cavity is completely filled.

The model is preferably enclosed in sand, which does not include a binding agent in the sand. The number, shape, orientation and size of pass-through holes can vary so long as they allow access to the interior of the casing or dome-shaped portions.

In accordance with the objects described above, the invention is a method for making a differential case metal casting or similar article and the resulting product. The method comprises the following steps: (a) providing an in situ destroyable foam pattern to form an integral one-piece differential case casting of a desired shape. The pattern has a hollow body including a substantially annular central wall section and axially spaced side wall sections adjacent to opposite ends of the central wall section forming an internal cavity within the hollow body of the foam pattern. The pattern (and, thus, the differential case) includes two sets of openings on the side wall sections of the hollow body of the pattern adjacent to the respective opposite end of the central wall section. In the subsequent step (b), the mold pattern is embedded in unbonded sand so that the unbonded sand is at least partially introduced into the cavity in the mold pattern through the plurality of openings in said hollow body. The new method of the present invention allows sand to flow freely into the cavity of the mold pattern, without the need for substantial shaking of the molding flask.

DETAILED DESCRIPTION OF PREFERRED EMBODIMENTS

Figure 1:
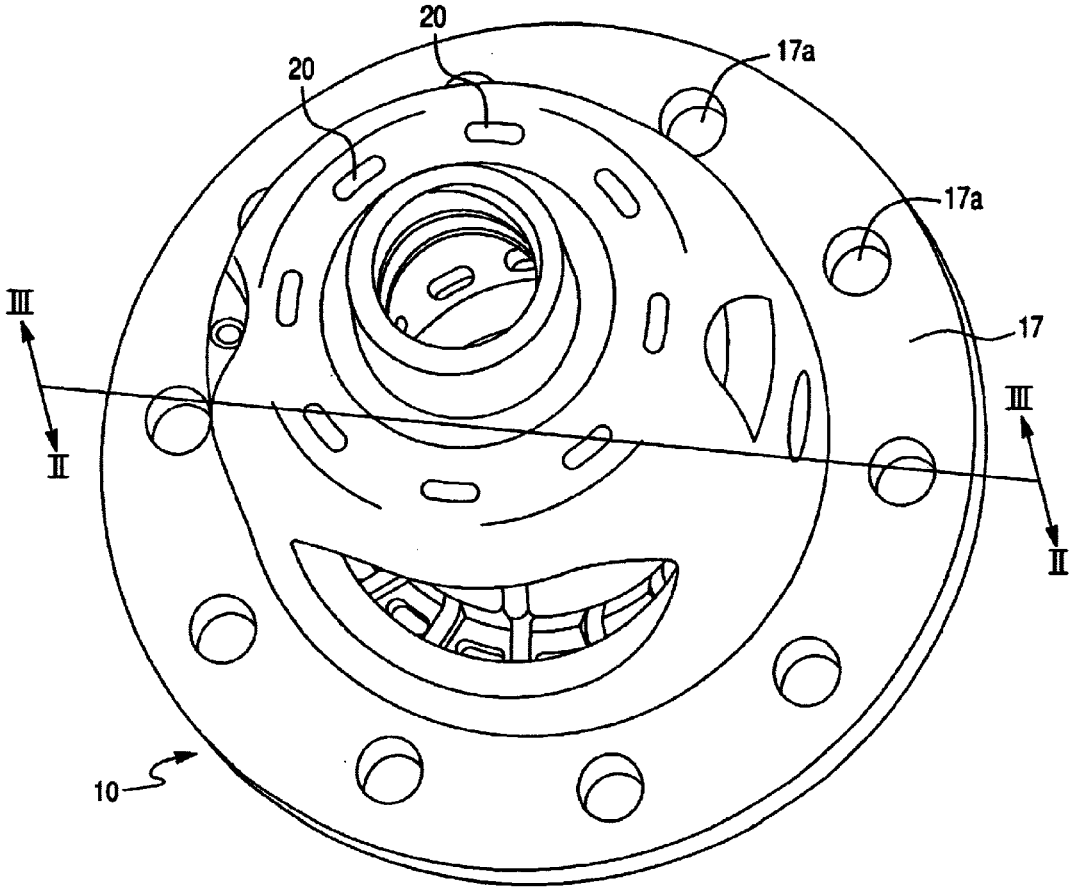
FIG. 1 perspective view of a differential case showing the pass-through holes of a preferred embodiment.
Figure 2:
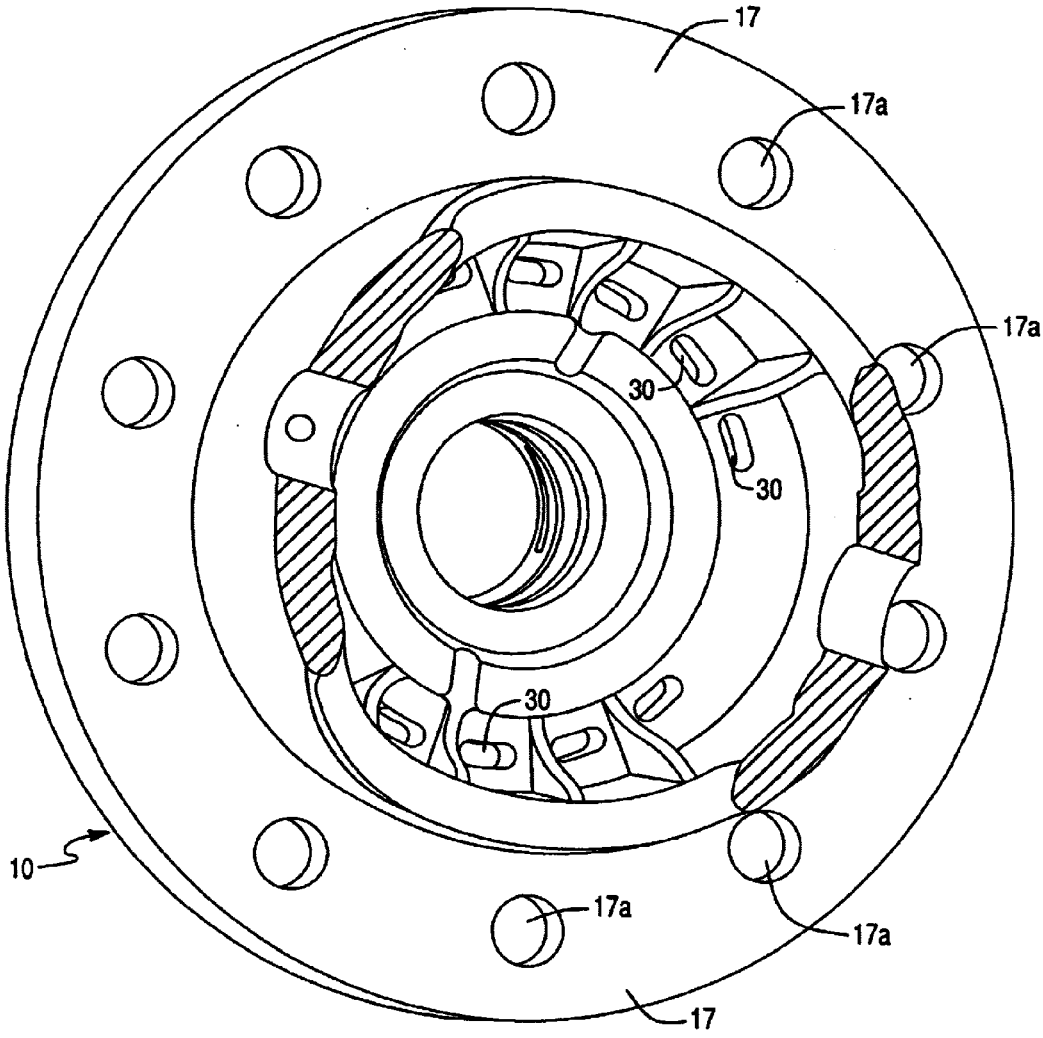
FIG. 2 is a partial cross-section view of the differential case taken along line II—II of FIG. 1.
Figure 3:
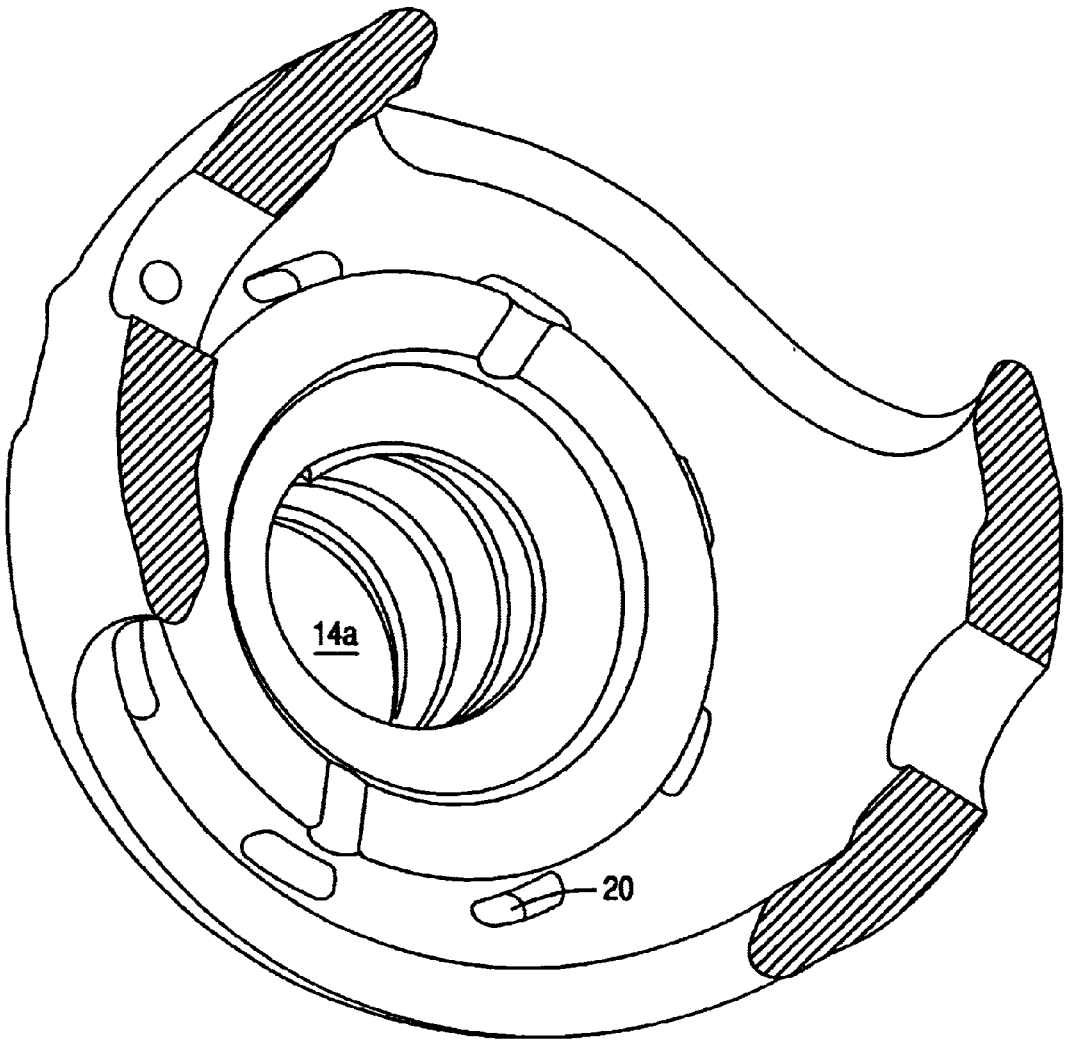
FIG. 3 is a partial cross-section view of the differential case taken along line III—III of FIG. 1.
Figure 4:
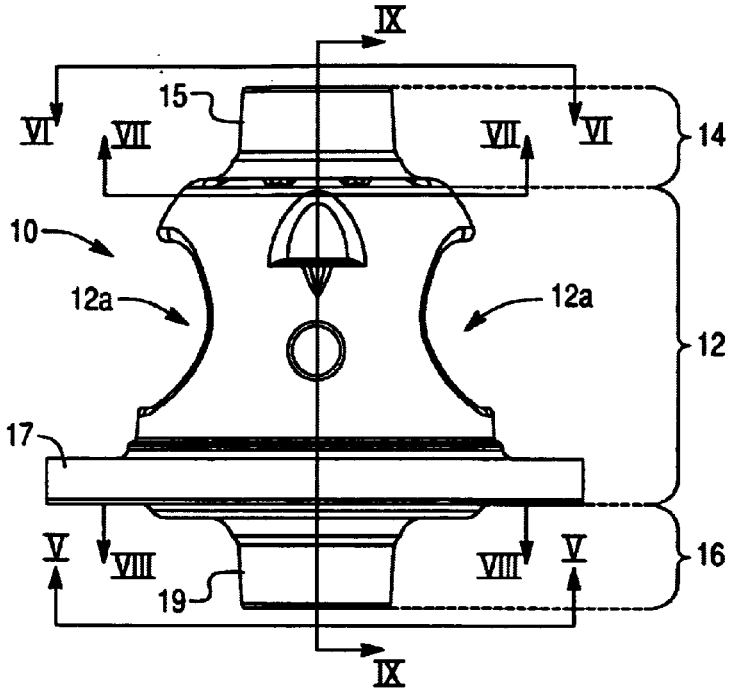
FIG. 4 is a side view of the differential case of FIG. 1.
Figure 5:
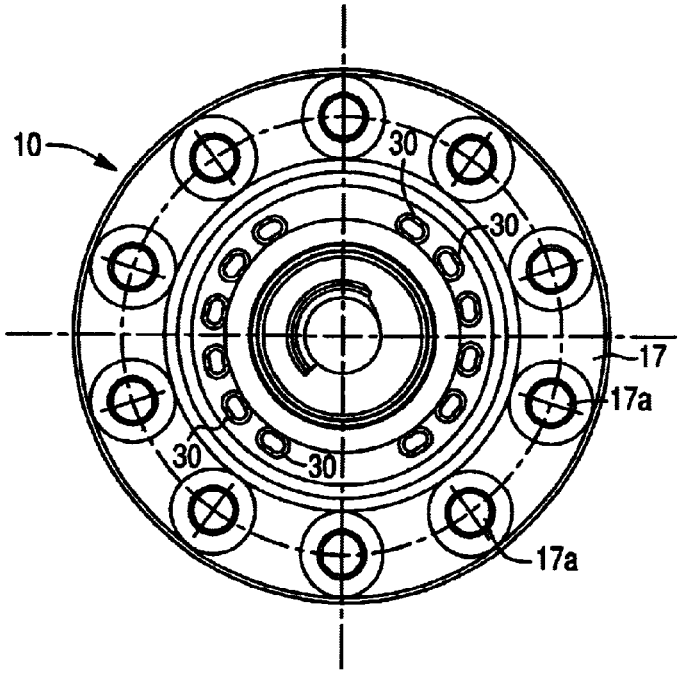
FIG. 5 is a cross section view of the differential case taken along line V—V of FIG. 4.
Figure 6:
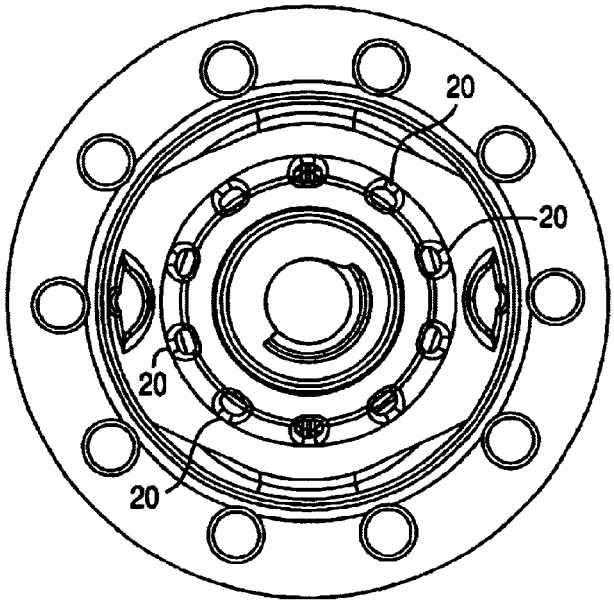
FIG. 6 is a cross section view of the differential case taken along line VI—VI of FIG. 4.
Figure 7:
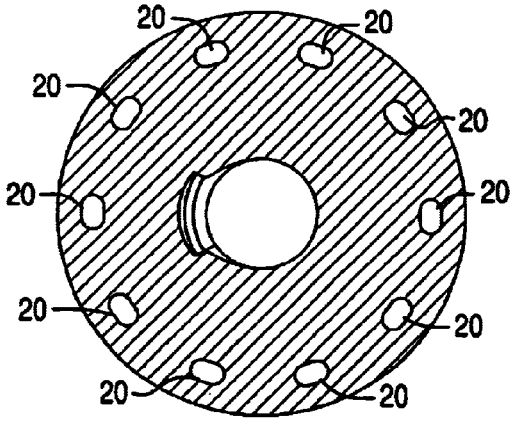
FIG. 7 is a cross section view of the differential case taken along line VII—VII of FIG. 4.
Figure 8:
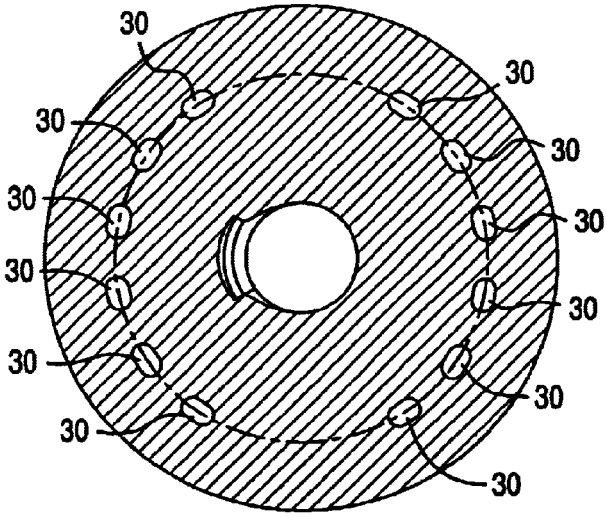
FIG. 8 is a cross section view of the differential case taken along line VIII—VIII of FIG. 4.
Figure 9:
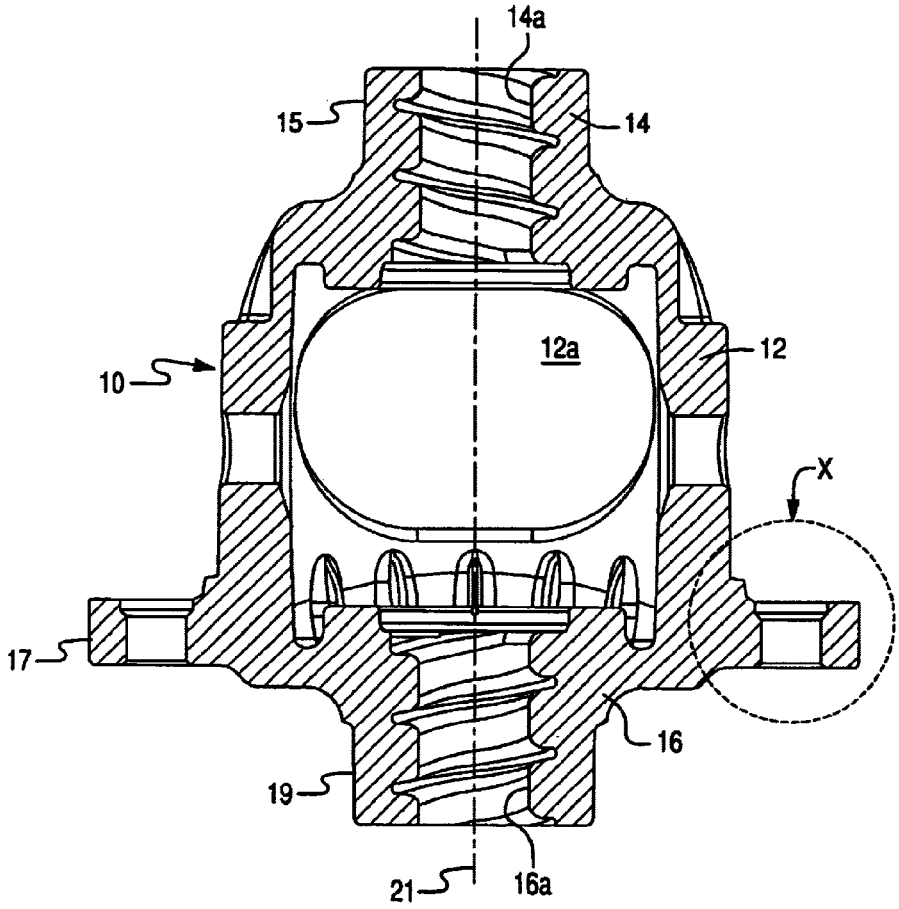
FIG. 9 is a cross section view of the differential case taken along line IX—IX of FIG. 4.
Figure 10:
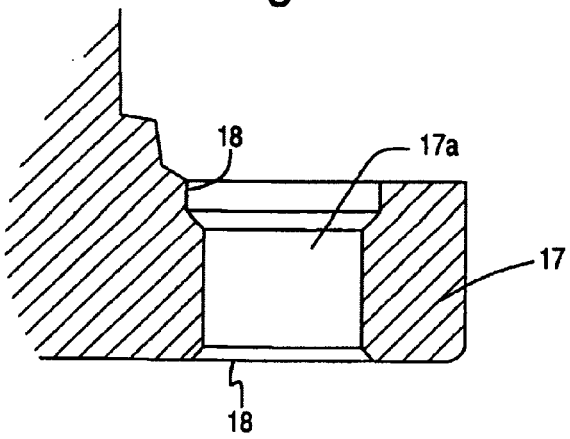
FIG. 10 is an enlarged partial sectional view of the chamfered bolt holes shown in a circle 'X' in FIG. 9.
Figure 11A:
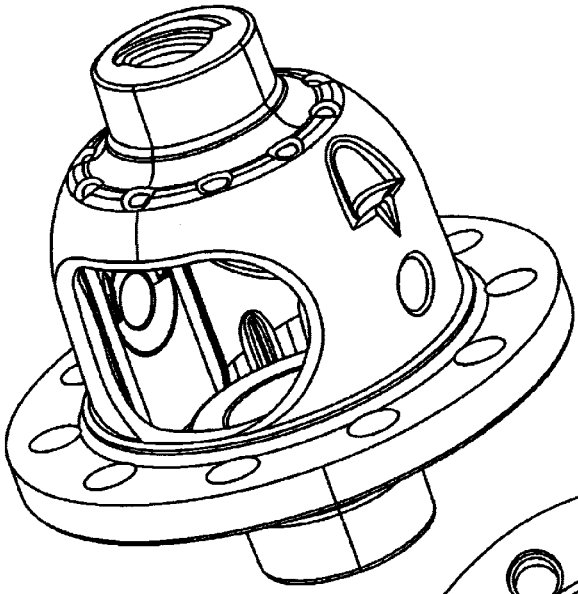
FIGS. 11*a*–11*c* are line drawings for the solid model shown in FIGS. 1–3.
Figure 11B:
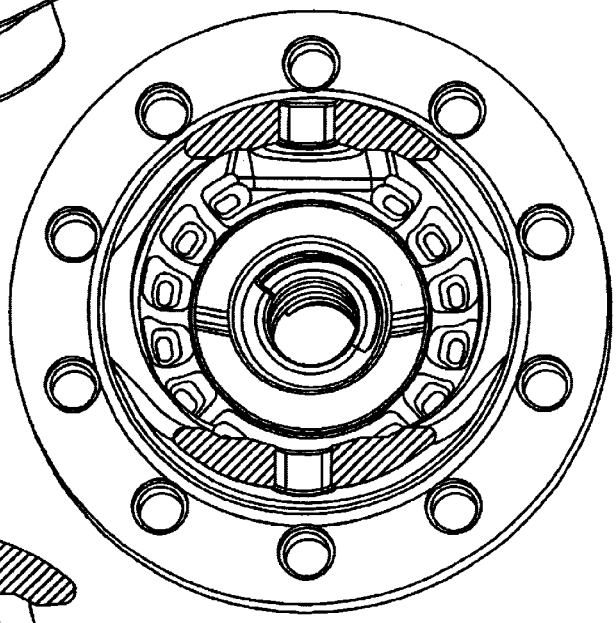
Figure 11C:
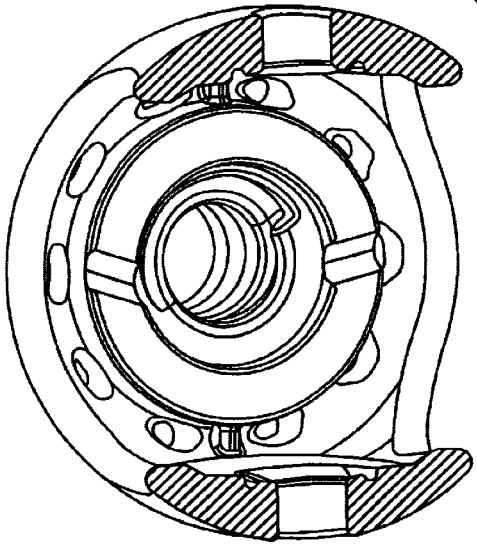

With reference to FIG. 1, the invention is a method for making a differential case metal casting. The method comprises the step of providing an in situ destroyable foam pattern 10 as shown in FIGS. 1–10 to form an integral one-piece differential case casting of the desired shape identical also to the product shown in FIGS. 1–10. The pattern has a hollow body including a substantially annular central wall section 12 and axially spaced side wall sections 14, 16 adjacent to opposite ends of the central wall section 12 forming an internal cavity within the hollow body of the foam pattern. See FIG. 4. The pattern (and, thus, the differential case) includes two sets of pass-through openings 20, 30 on the side wall sections 14, 16 of the hollow body of the pattern adjacent to the respective opposite end of the central wall section 12.

In the subsequent step of the method, the mold pattern is embedded in unbonded sand so that the unbonded sand is at least partially introduced into the cavity in the mold pattern through the plurality of pass-through openings 20, 30 in the hollow body. The new method of the present invention allows sand to flow freely into the cavity of the mold pattern, without the need for substantial shaking of the molding flask.

According to the evaporative or lost foam casting process used as part of this invention, molten metal is introduced into a space defined by the molding flask or pattern whereby heat of the molten metal will vaporize the molding flask or pattern and assume the shape of the space defined by the molding flask or pattern.

As shown in FIGS. 1–8, the plurality of pass-through openings 20, 30 extend parallel to a common axis defined by the substantially tubular central wall section 12. The common axis lies along the section line IX—IX shown in FIG. 4.

It should be noted that each of the axially spaced side wall sections 14, 16 comprises a trunnion 15, 19, respectively, and an axle aperture 14*a*, 16*a* aligned along the common axis 21, and the plurality of pass-though openings 20, 30 are disposed about the common axis. Preferably, the plurality of pass-through openings 20, 30 extends parallel to the common axis and circumscribes the axle apertures 14*a*, 16*a*. As with all one-piece differential cases, the substantially tubular central wall section 12 comprises at least one window 12*a* formed therein in order to permit assembly of the differential components, i.e. the pinion and side gears, into the hollow body defined by the differential case. Likewise, the axially spaced side wall section 16 comprises a flange portion 17 formed with a plurality of bolt holes 17*a*.

The bolt holes 17*a* are cast in place during the molding process to allow the bolting up of the ring gear (not shown) to the differential case using the lost foam process for making the differential case. The cast in holes 17*a* preferably include chamfers 18 on both sides of the flange 17. It should be noted that it appears the size of the bolt holes 17*a* must be increased to allow for the desired casting accuracy. In view of this arrangement, the bolt head (not shown) will be larger to have proper clamping force in order to prevent the bolt from loosening during operation.

From the foregoing description, it is clear that the present invention improves the full mold casting process so that moldings with crucial cavities can also be molded and filled safely by the molding sand. The method and assembly of this invention achieves a system where the molding sand can be distributed in a controlled manner without excessive shaking.

The primary objects of the invention are attained in that the part is formed with cast-in bolt holes 17*a* on the flange 17 for mounting the ring gear and, additionally, holes are provided on the dome-shaped portion, i.e., the flange and button sides of the differential case, that allow sand to freely flow into the interior of the casting.

In an advantageous process described above, the cost of machining the bolt holes is reduced and the weight of the part is reduced and damage to the foam pattern is reduced or eliminated. As a result, dimensional inaccuracies of the part are reduced or eliminated.

By introducing the flow-through holes into the casting model, preferably through the flange and button sides, all cavities of the casting model are completely filled with sand and the latter is compressed against the model. The rising of the sand in the model cavity is facilitated by the fact that the filling level of the molding sand is kept nearly constant near the model cavity to be filled until the cavity is completely filled.

The model is preferably enclosed in sand, which does not include a binding agent in the sand. The number, shape, orientation and size of pass-through holes can vary so long as they allow access to the interior of the casing or dome-shaped portions.

While the foregoing invention has been shown and described with respect to a preferred design related to a one-piece differential case, it will be understood by those of skill in the art that various changes in form and detail may be made therein without departing from the spirit and scope of the instant invention. For example, the exact arrangement of the chamfers for the bolt holes may be varied to provide the most effective design to mount the ring gear to the flange of the differential case. Moreover, the precise location of the pass-through openings may be varied to permit efficient distribution of the sand with respect to the model cavity. To wit, the pass-through opening may be disposed adjacent the windows formed in the tubular central wall section.

What is claimed is:

1. A method for making a gear case by metal casting, said method comprising the steps of:

(a) providing an in situ destroyable pattern to form an integral one-piece gear case casting of a desired shape, said pattern having a hollow body including a circumferentially continuous substantially tubular central wall section and axially spaced side wall sections adjacent to opposite ends of said central wall section, said central and side wall sections forming an internal cavity within said hollow body, wherein one of said axially spaced side wall sections comprises a flange portion radially extending away from said central wall section and provided with a plurality of bolt apertures having a shape of a bolt hole; and (b) embedding said pattern in an unbonded sand so that said unbonded sand is at least partially introduced into said cavity in said pattern;

wherein each of said plurality of bolt apertures having a chamfer edge on at least one side of said flange portion.

2. The method of claim 1, further comprising the step of introducing a molten metal into a space defined by said pattern whereby heat of the molten metal will vaporize the pattern and assume the shape of the space defined by said pattern.

3. The method of claim 1, wherein said pattern is further provided with a plurality of pass-through openings on at least one of said axially spaced side wall sections.

4. The method of claim 3, wherein said plurality of pass-through openings extend parallel to a common axis defined by said substantially tubular central wall section.

5. The method of claim 3, wherein each of said axially spaced side wall sections comprises a trunnion and an axle aperture aligned along a common axis, and wherein said plurality of pass-through openings are disposed about said common axis.

6. The method of claim 5, wherein said pass-through openings circumscribe at least one of said axle apertures.

7. The method of claim 3, wherein said unbonded sand is at least partially introduced into said cavity in said pattern through said plurality of pass-through openings in the step of embedding said pattern in said unbonded sand.

8. The method of claim 1, wherein said substantially tubular central wall section comprises at least one window formed therein.

9. The method of claim 1, wherein said chamfer edge is provided on both sides of said flange portion for each of said plurality of bolt apertures.

* * * * *